US009976359B2

(12) United States Patent
Li et al.

(10) Patent No.: US 9,976,359 B2
(45) Date of Patent: May 22, 2018

(54) WASHPIPE ASSEMBLY

(71) Applicants: Xuejun Li, Beijing (CN); Chen Liu, Beijing (CN); Jie Cui, Beijing (CN)

(72) Inventors: Xuejun Li, Beijing (CN); Chen Liu, Beijing (CN); Jie Cui, Beijing (CN)

( * ) Notice: Subject to any disclaimer, the term of this patent is extended or adjusted under 35 U.S.C. 154(b) by 414 days.

(21) Appl. No.: 14/840,934

(22) Filed: Aug. 31, 2015

(65) Prior Publication Data

US 2016/0369575 A1 Dec. 22, 2016

(30) Foreign Application Priority Data

Jun. 19, 2015 (CN) ..... 2015 1 0346602

(51) Int. Cl.
*E21B 17/05* (2006.01)
*E21B 21/02* (2006.01)

(52) U.S. Cl.
CPC ..... *E21B 17/05* (2013.01); *E21B 21/02* (2013.01)

(58) Field of Classification Search
CPC .... E21B 33/0415; E21B 17/05; F16L 27/026; F16L 27/125; F16L 27/053; F16L 27/1012; F16L 27/1021
USPC ..... 285/147.2, 145.2, 302, 280, 281, 298, 285/223, 224; 166/75.11
See application file for complete search history.

(56) References Cited

U.S. PATENT DOCUMENTS 686,598 A * 11/1901 Evans ..... F16L 27/12 285/302
2,955,850 A * 10/1960 Bellinger ..... F16L 27/026 285/302
3,427,051 A * 2/1969 White ..... F16L 27/026 285/302
4,556,239 A 12/1985 Eriksson
5,160,174 A * 11/1992 Thompson ..... F16L 27/12 285/302
5,169,181 A * 12/1992 Timm ..... F16L 27/0828 285/279

(Continued)

FOREIGN PATENT DOCUMENTS

CN 2837498 11/2005
CN 2837498 11/2006

(Continued)

OTHER PUBLICATIONS

First Chinese Office Action, issued in the corresponding Chinese Patent application No. 201510346602.7, dated Mar. 29, 2017, 11 pages.

(Continued)

*Primary Examiner* — David Bochna
(74) *Attorney, Agent, or Firm* — Hamre, Schumann, Mueller & Larson, P.C.

(57) ABSTRACT

A washpipe assembly is described for a passage of pressurized drilling fluid from a stationary first conduit member to a rotating second conduit member. The washpipe assembly comprises a lower union secured to the rotating second conduit member, an upper union secured to the stationary first conduit member, a floating seal assembly attached to the upper union, a rotating seal ring attached to the lower union, and a stationary seal ring attached to the floating seal assembly. The washpipe assembly also includes a washpipe suspended inside the upper union and the floating seal assembly through a waveform snap ring.

10 Claims, 2 Drawing Sheets

(56) References Cited

U.S. PATENT DOCUMENTS

| | | | | |
|---|---|---|---|---|
| 5,577,775 | A * | 11/1996 | Pearson | F16L 27/082 285/279 |
| 6,007,105 | A * | 12/1999 | Dietle | F16L 27/0828 285/281 |
| 7,343,968 | B2 | 3/2008 | Kubala | |
| 2010/0225066 | A1 | 9/2010 | Huang | |

FOREIGN PATENT DOCUMENTS

| | | |
|---|---|---|
| CN | 201794536 | 4/2011 |
| CN | 102518801 | 6/2012 |
| CN | 202501010 | 10/2012 |
| CN | 204113106 | 1/2015 |

OTHER PUBLICATIONS

Second Chinese Office Action, issued in the corresponding Chinese Patent application No. 201510346602.7, dated Nov. 29, 2017, 17 pages.

* cited by examiner

WASHPIPE ASSEMBLY

BACKGROUND OF THE INVENTION

Field of the Invention

This application is related to a rotary seal assembly permitting a passage of high pressure fluid in the field of oil and gas drilling operations, particularly, to a washpipe assembly used in oil and gas drilling equipment, such as a drilling rig swivel, or a top drive.

Description of the Related Art

A washpipe device, which is utilized to provide a rotary passage between a gooseneck and a main shaft in order to deliver high pressure drilling fluid from mud pumps to a drilling bit, is one of the most important members of a drilling rig swivel or a top drives in oil and gas drilling operations. In particular, a washpipe assembly, which is easy to install and maintain, and which is operational with high pressure and of a long working life, contributes safety and efficiency of oil and gas operations.

There are two types of washpipe assembly, the traditional washpipe assembly which utilizes a stack of elastomeric rotary seals against the external cylindrical sealing surface of a metal pipe to provide a dynamic sealing arrangement, and the mechanical seal washpipe device which utilizes a floating seal member together with rotating seal ring and stationary seal ring to provide a dynamic sealing arrangement. The traditional type have a limited lifetime of approximately 200 hours or less in average, and have difficulty to replace the sealing arrangement because the device is installed at a high location, in a limited space, and configured with heavy hammer unions.

U.S. Pat. No. 7,343,968 B2 issued on Mar. 18, 2008 to Zbigniew Kubala provides a mechanical seal type sealing arrangement which utilizes a floating seal assembly having a stationary seal ring mounted to first drilling fluid conduit member or gooseneck and which is structurally arranged to engage a rotating seal ring which is mounted to a second conduit member or the rotating main shaft. The tubular washpipe member is structurally fixed to the stationary structure, and the floating seal assembly is aligned to the stationary structure with anti-rotating pins.

During the operation, as the rotating main shaft brings the rotating seal ring to rotate while the stationary seal ring is pressed to the rotating seal ring without rotation, the friction between the two rings is delivered from the stationary seal ring to the stationary structure through the floating seal member and the anti-rotating pins, and in the meantime, the rotating main shaft produces shaft runout and axis jump. The force between the floating seal member and the anti-rotating rods damages the floating function of the floating seal assembly. The fixed installation of the washpipe member with respect to the stationary structure and the limited cylindrical clearance between the floating seal member and the washpipe member also limits the following capacity of the stationary seal ring to the rotating seal ring. The limited floating and/or following capacity of the above mentioned washpipe assembly asks a demanding installation interface, which results in a difficult installation and commissioning work.

In prior arts, the O-ring groove for installing the O-ring between the upper seal ring and the floating seal member is configured in the floating seal member, and the O-ring groove for installing the O-ring between the lower seal ring and the lower nut is configured in the lower nut. Because the O-ring grooves are directly exposed to the drilling fluid during the operations, and the space for replacing the seal rings is very limited, it takes time to clean the grooves when replacing seal rings, which results in an extended downtime of the drilling operations.

SUMMARY OF THE INVENTION

The present invention has been made to overcome or alleviate at least one aspect of the above mentioned disadvantages.

Accordingly, it is an object of the present invention to provide a washpipe assembly which has an improved following capacity of the stationary seal ring to the rotating seal ring, which results in an easy and short installation and commissioning work.

Another object of the present invention to provide stationary seal ring and rotating seal ring which are structurally arranged with O-ring chamber configured in the ceramic ring opposite the seal face, which results in an easy and short maintenance work.

In an exemplary embodiment of the invention, there is provided a washpipe assembly comprising: a lower union secured to a rotating conduit member; an upper union secured to a stationary conduit member; a floating seal assembly secured to said upper union, said floating seal assembly comprising a floating member, a fixed member secured to said upper union and configured to guide said floating member, and a spring member installed between said floating member and said fixed member such that said floating member is movable in an axial direction relative to said fixed member; a rotating seal ring attached to said floating seal assembly; a stationary seal ring attached to said lower union; and a washpipe hung up inside said upper union and said floating seal assembly through a waveform snap ring mounted between said upper union and said floating seal assembly.

In another exemplary embodiment, said floating member is composed of a floating tube and a lower flange installed onto said floating tube; said stationary seal ring is mounted to said floating tube, and a first end of said spring member is supported by said lower flange; and said fixed member comprises a tubular pilot and an upper flange, said tubular pilot being configured to guide a movement of said floating member, a second end opposite said first end of said spring member being attached to said upper flange.

In a further exemplary embodiment, one of said tubular pilot and said floating tube is formed with a piloting groove, and the other one of said tubular pilot and said floating tube is formed with a raised part sliding axially in said piloting groove.

In a still further exemplary embodiment, said spring member is composed of a spring, and a guide rod installed inside said spring, and a first end of said guide rod is fixed to said upper flange and an end opposite the first end of said guide rod is configured to allow said lower flange to approach to or depart from said upper flange axially.

In a still further exemplary embodiment, elastomeric seals are disposed between an outer circumference of said washpipe and the inner circumference of said upper union, and between an outer circumference of said washpipe and an inner circumference of said floating tube.

In a still further exemplary embodiment, said upper flange is formed with a positioning stage on an inner circumference thereof, and a first end of said waveform snap ring is attached to said positioning stage of said upper flange and a second end of said waveform snap ring opposite to the first end is attached to a positioning stage formed in said upper union.

In a still further exemplary embodiment, a first gap is provided between the top of said raised part and the bottom of said piloting groove, and/or, a second gap is provided between the outer circumference of said floating tube and the inner circumference of said lower flange, and/or, a third gap is provided between said guide rod and said lower flange.

In a still further exemplary embodiment, each of said stationary seal ring and said rotating seal ring is composed of an inner ceramic ring and an outer metal ring.

In a still further exemplary embodiment, said metal rings of said stationary seal ring and said rotating ring are non-rotatably installed to said floating assembly and said lower union, respectively.

In a still further exemplary embodiment, each of the ceramic ring of said stationary seal ring and the ceramic ring of said rotating seal ring is provided with an O-ring chamber on an end opposite a seal end thereof, and wherein an O-ring is installed in the O-ring chamber to provide a sealing effect between said stationary seal ring and said floating tube, and between said rotating seal ring and said lower union.

The present invention consists of the following major novel features and structural details hereinafter described, to overcome the deficiencies of the washpipe device described in the previous arts.

The configuration of a suspended washpipe, the elastomeric seal and the gap configured between the washpipe and the upper union, and the elastomeric seal and the gap configured between the washpipe and the floating tube, the configured gap between the floating tube and the fixed member, and the configured gap between the floating tube and the lower flange, provides a motion liberty of the floating seal assembly of both axial jump and axial fluctuation, and thus provides an excellent following nature of the stationary seal ring to the rotating seal ring.

The configuration of the O-ring groove built on the ceramic ring provides a solution of a reliable seal and an ease work to replace the stationary seal ring and the rotating seal ring.

The present invention provides a washpipe assembly which is operating at a pressure up to 7,500 psi, and which can be applied in top drives and drilling rig swivels, easy to install and commission, easy to maintain, reliable and of extended work life, and which improve safety and efficiency of the oil and gas drilling operations.

BRIEF DESCRIPTION OF THE DRAWINGS

The above and other features of the present invention will become more apparent by describing in detail exemplary embodiments thereof with reference to the accompanying drawings, in which.

DETAILED DESCRIPTION OF PREFERRED EMBODIMENTS OF THE INVENTION

Figure 1:
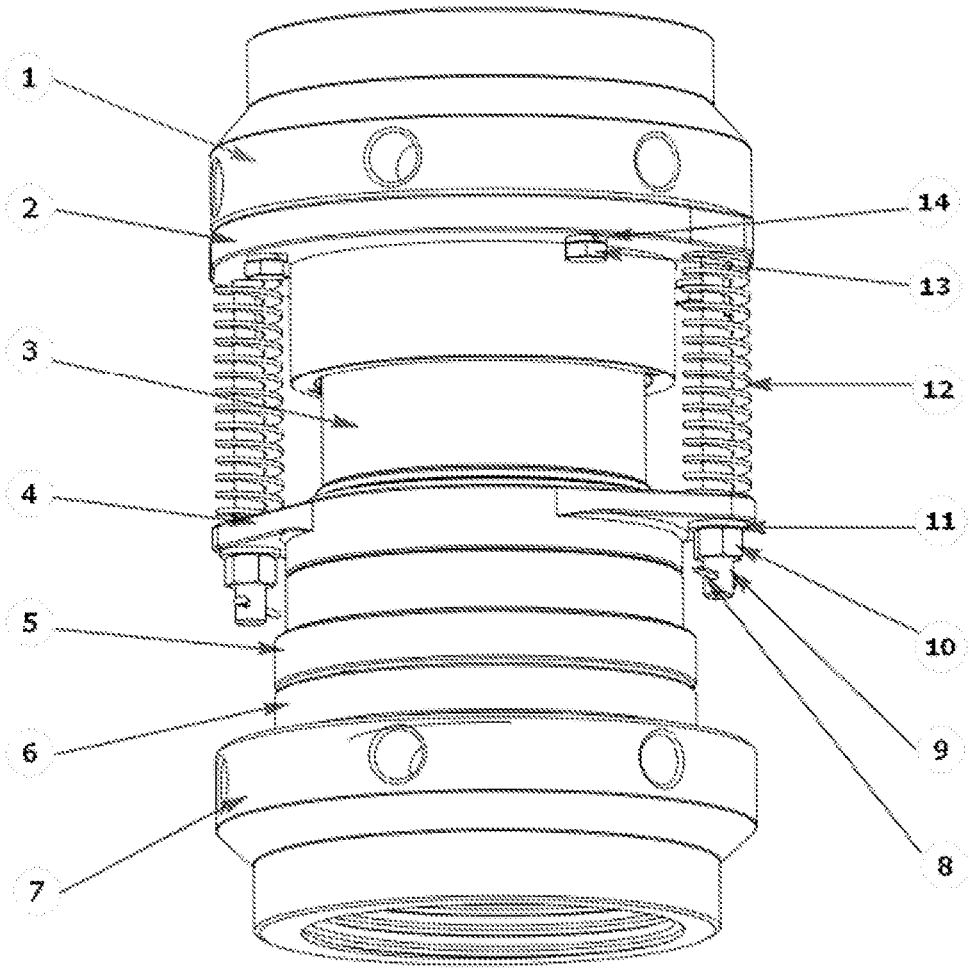
FIG. 1 is an illustrative perspective view showing a washpipe assembly according to an embodiment of the invention.

Exemplary embodiments of the present disclosure will be described hereinafter in detail with reference to the attached drawings, wherein the like reference numerals refer to the like elements. The present disclosure may, however, be embodied in many different forms and should not be construed as being limited to the embodiment set forth herein; rather, these embodiments are provided so that the present disclosure will be thorough and complete, and will fully convey the concept of the disclosure to those skilled in the art.

Figure 2:
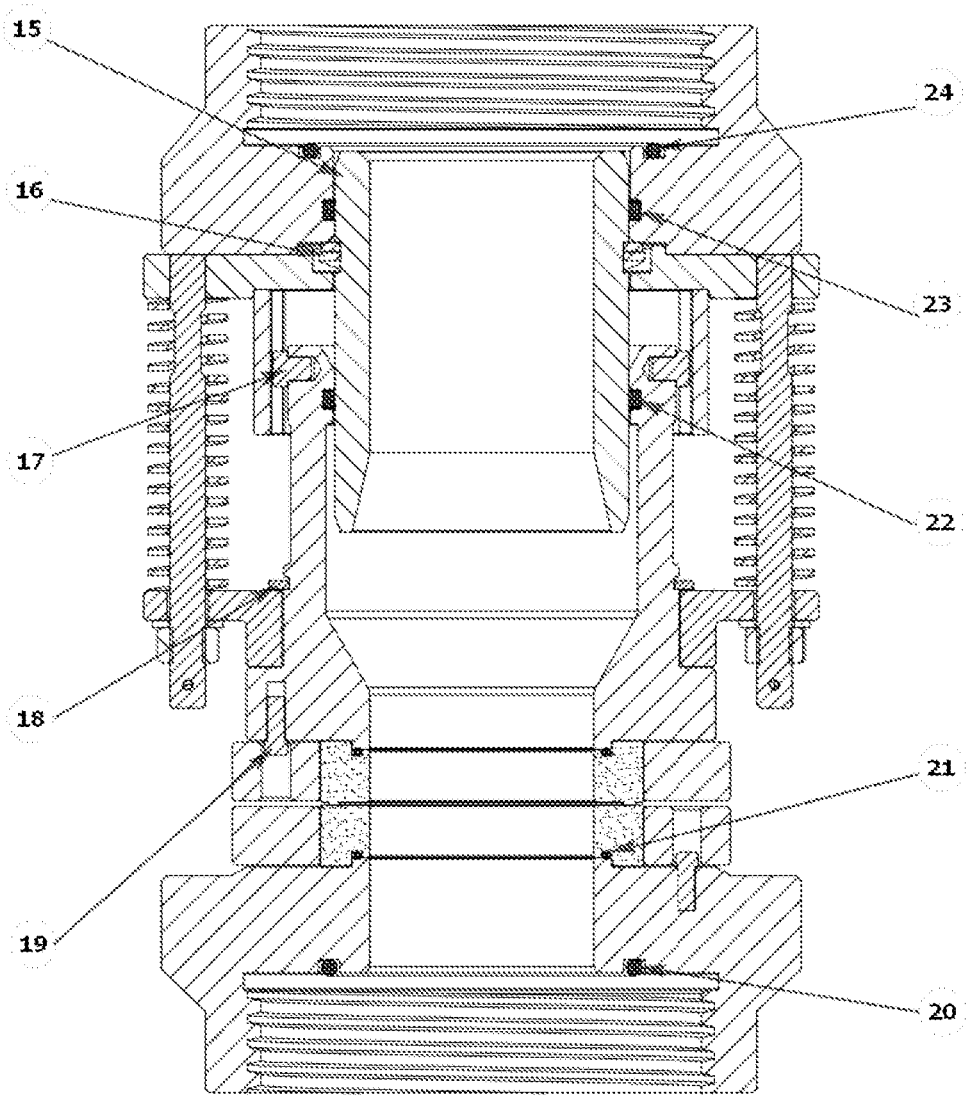
FIG. 2 is an illustrative sectional view showing the washpipe assembly shown in FIG. 1.

Refer to FIG. 1 and FIG. 2, it is illustrated a preferred embodiment of the present invention which relates to a washpipe assembly incorporating an upper union 1, a floating seal assembly secured to said upper union 1, a stationary seal ring 5 attached to said floating seal assembly, a lower union 7, a rotating seal ring 6 attached to said lower union 7, and a washpipe 15 suspended inside and between said upper union 1 and said floating seal assembly through a waveform snap ring 16. Said floating seal assembly is composed of a floating member, a fixed member 2 secured to said upper union 1 and configured to guide said floating member, and a spring member installed between said floating member and said fixed member 2 to allow reciprocating motion of said floating member.

In particular, said floating member is composed of a floating tube 3 and a lower flange 4 which is installed onto said floating tube 3. A fixed member 2 incorporates a tubular pilot and an upper flange. As shown in FIG. 1 and FIG. 2, said tubular pilot is configured below said upper flange. A piloting groove is configured on the inner wall of said tubular pilot to house a pin 17 installed on the top end of said floating tube 3, in order to permit the axial motion and the axial runout of said floating tube 3 while limiting the relative rotation of said floating tube 3 with respect to said fixed member 2. In an alternative embodiment, said pin 17 may be a raised part configured at the top end of said floating tube 3.

Refer to the preferred embodiment as shown in FIG. 1 and FIG. 2, said spring member includes a guide screw 9 and a spring 12, with said guide screw 9 installed inside said spring 12, and having a first end of said guide screw 9 fixed to said top flange, and a second end opposite said first end of said guide screw 9 axially aligns said lower flange 4. In this way, said guide screw 9 basically secures the position of said spring 9 while being compressed, and allows the reciprocating axial motion of said lower flange 4 with respect to said upper flange.

As described in the preferred embodiment of the present invention, a snap ring 18 and a pin 19, together with said pin 17 and said lower flange 4 are installed onto said floating tube 3, respectively. Said snap ring 18 is mounted onto the groove on the outer circumference to axially secure said lower flange 4. There are axial grooves with rectangular cross-section configured on the inner wall of the tubular pilot of said fixed member to embed said pin 17 keyed into said floating tube 3. A first end of said guide screw 9 is fixed to said upper flange of said fixed member 2, a second end opposite said first end of said guide screw goes through a bolt hole of said lower flange 4 with said spring 12 installed between said upper flange and said lower flange 4. A plain washer 14, a hex nut 10 and a cotter pin 8 are installed onto said second end of said guide screw 9, respectively. Said pin 17 is configured to prevent said floating tube 3 from rotating relative to said fixed member 2 while allowing an axial reciprocating movement there between. Said spring 12 is readily compressed by said nut 10 during the installation, and said cotter pin 8 installed at said second end of said guide screw 9 prevents a drop of said loose nut 10 and said washer 11 during operations. The above illustrates the structure and the procedure of said floating seal assembly.

As shown in FIG. 2, the preferred embodiment of the present invention also includes a washpipe 15 installed in the bore of said upper union 1 and said floating seal assembly, which is sealed up with said upper union 1, and with said floating tube 3, through the seals embedded in the inner diameter of said upper union 1 and said floating tube 3, respectively.

In particular, a seal 22 is installed in the chamber configured on the inner circumference of said floating tube 3, and a seal 23 is installed in the groove configured on the inner periphery of said upper union 1. Said washpipe 15 goes through said seal 22 and said seal 23 to provide a high pressure fluid conduit from the top end of said upper union 1 to the lower end of said floating tube 3, refer to FIG. 2. There is a circular groove configured on the outer periphery of said washpipe 15, onto which a waveform snap ring 16 is installed. The lower end of said washpipe 15 goes into the inner bore of said floating seal assembly and hangs up on the circular stage configured on the inner circumference of said upper flange through said waveform snap ring 16, then the upper end of said washpipe 15 goes into the bore of said upper union 1, so that said waveform snap ring 16 is axially secured in the circular groove formed between said upper union 1 and said fixed member 2. Thus, said washpipe 15, which is bouncily suspended in the bore of said upper union 1 and said seal floating seal assembly, may swing besides jump, depending on the clearances configured there between. Said fixed member 2 is secured onto said upper union 1 by a hex bolt 13 and a spring washer 14, as shown in FIG. 1.

The elasticity of said waveform snap ring 16 permits an axial reciprocating movement of said washpipe 15, and also, the elastomeric seal configured between the outer diameter of said washpipe 15 and the inner diameter of said upper union 1, and the elastomeric seal configured between the outer diameter of said washpipe 15 and said floating tube 3, allows an axial swing at the pivot of said waveform snap ring 16.

In addition, it is apparent that one or a combination of the following configurations may increase the amplitude of the fluctuation between said fixed member 2 and said floating tube 3, in order to provide a good fluctuation that said stationary seal ring 5 needs to follow said rotating ring 6 secured to the main shaft:

1. an increase of the clearance between the inner diameter of said union 1 and the outer diameter of said washpipe 15;
2. an increase of the clearance between the inner diameter of said floating tube 3 and the outer diameter of said washpipe 15;
3. a suitable clearance between the inner diameter of said lower flange 4 and the outer diameter of said floating tube 3;
4. a suitable clearance between said guide screw 9 and the bolt hole at said lower flange 4; and
5. a compatible clearance between the piloting groove of said fixed member 2 and said pin 17 keyed to said floating tube 3.

The above configurations can provide an important advantage, because the vibration and swing of the main shaft during the oil and gas drilling operations calls for a good floatability of said floating seal assembly to ensure a good tracing of said stationary seal ring 5 to said rotating seal ring 6 and to ensure the tightness between said stationary seal ring 5 and said rotating seal ring 6.

Refer to FIG. 1 and FIG. 2, each of said stationary seal ring 5 or said rotating seal ring 6 is composed of an ceramic ring which is installed within a steel ring, and said ceramic ring of said stationary seal ring 5 is pressed to said ceramic ring of said rotating seal ring 6 driven by said floating seal assembly. Said steel ring of said stationary ring 5 is mounted to said floating tube 3 of said floating seal assembly, and said steel ring of said rotating seal ring 6 is mounted to said lower union 7.

In particular, there is a circular groove configured on said ceramic ring, and there are through holes configured on said steel ring. An O-ring 21 is installed to said groove of said ceramic ring of said stationary seal ring 5 and of said rotating seal ring 6, respectively. It is configured a positioning stage between said floating tube 3 and said ceramic ring of said stationary seal ring 5, and said O-ring 21 installed in said groove seals up said floating tube 3 and said stationary seal ring 5, and said pin 19 fixed onto said floating tube 3 is pinned into the through hole of said steel ring of said stationary seal ring 5 to prevent the relative rotation between said floating tube 3 and said stationary seal ring 5. Similarly, there is a positioning stage between said ceramic ring of said rotating seal ring 6 and said lower union 7, and said O-ring 21 installed in said groove seals up said lower union 7 and said rotating seal ring 6, and said pin 19 fixed onto said lower union 7 is pinned into the through hole of said steel ring of said rotating seal ring 6 to secure the synchronized motion of said rotating seal ring 6 and said lower union 7.

Because said O-ring 21 is installed in said groove of said ceramic ring, and the seal chamber is configured with the positioning stage between said ceramic ring of said stationary seal ring 5 and said floating tube 3, and/or, said ceramic ring of said rotating seal ring 6 and said lower union 7, respectively, it is easier to replace the seal rings, and it provides more reliable sealing therebetween, as compared to the previous arts described in U.S. Pat. No. 7,343,968. Thus, the ease in changing the seal rings and providing a more reliable sealing solution is another important advantage of the present invention.

The operation of the present invention in a top drive or a drilling rig swivel is also illustrated with reference to FIG. 1 and FIG. 2. Said upper union 1 is mounted to the lower end of a gooseneck through thread connection, an O-ring 24 installed in the seal groove of said upper union 1 to achieve sealing between the gooseneck and said upper union 1. With the utility of said O-ring 24, said seal 23, said seal 22, said washpipe 15, said fixed member 2, said floating tube 3, said waveform snap ring 16, said bolt 13 and said spring washer 14, a high pressure passage from the gooseneck to said floating tube 3 is secured, and a relative rotation of said floating tube 3 with respect to the gooseneck is avoided. The configuration of said pin 17, said piloting groove of said fixed member 2, said guide screw 9, said spring 12, said lower flange 4, and said snap ring 18, provides a suitable liberty of said floating tube 3 on both reciprocating motions of axial jump and of axial fluctuation. Said lower union 7 is mounted to a main shaft through thread connection, and an O-ring 20 installed in the groove of said lower union 7 to seal up said lower union 7 and the main shaft. Said nut 10 is fully loosed during the operation, said spring 12 pre-compressed between said top flange and said lower flange drives said floating tube 3, said stationary seal ring 5, said rotating seal ring 6, and said lower nut 7 to press one to another, respectively. Said pin 19 is fixed on said floating tube 3 and said lower union 7, respectively, which is keyed to the through hole of said steel ring, to ensure that there is no relative rotation between said stationary seal ring 5 and said floating tube 3, and between said rotating seal ring 6 and said lower union 7, respectively. Either said upper union 1 or said lower union 7 are configured with left thread, to ensure the tightness of the connection with the gooseneck or the main shaft during the operation, respectively.

Said stationary seal ring 5 does not rotate while said rotating seal ring 6 is rotating with the main shaft, and said stationary seal ring 5 is being pressed onto said rotating seal ring 6 during the operation of the present invention. The advantages of the present invention as illustrated above, such as the arrangement of said floating seal assembly, the configuration with a suspension of said washpipe, and the configuration of the anti-rotations with said pin 19 and said piloting groove, provide an adequate motion liberty to said stationary seal ring 5 to follow a reciprocating movement of said rotating seal ring 6, both axial jump and axial swing. By adjusting the squeezing force of said spring 12, a better tightness between said stationary seal ring 5 and said rotating seal ring 6 may be achieved.

During the operation of the present invention, said nut 10 is fully loosed and the force of said pre-compressed spring 12 is applied between said top flange and said lower flange 4. First, prior to change or replace said stationary seal ring 5 and/or said rotating seal ring 6 of the present invention, make sure that the mud pump is powered off and the main shaft does not rotate. Second, turn said nut 10 clockwise with a spanner wrench to lift said floating tube 3 while compressing said spring 12 through said washer 11, said lower flange 4 and said snap ring 18, until said pin 19 fully comes out of the through hole of said stationary seal ring 5. Third, slip out said stationary seal ring 5 and said rotating seal ring 6, and swipe the positioning boss of said floating tube 3 and said lower union 7. Forth, install a new rotating seal ring 6 with a new O-ring 21 installed, making sure said pin 19 fixed on said lower union 7 keys into the through hole of said steel ring. Fifth, slip in a new stationary seal ring 5 with a new O-ring 21 installed, and fully loose said nut 10 to lower down said floating tube 3, and make sure to have said pin 19 on said floating tube 3 going in the through hole of the new stationary seal ring 5. Sixth, make sure said cotter pin 8 is secured to prevent the dropping of said nut 10 and said washer 11. With reference to the above description on the replacing of the seal rings, the ease of the replacing of the seal rings is an important advantage of the present invention.

The present invention consists of certain novel features and structural details, overcomes the deficiencies of the traditional stacked sealing system and the prior arts comprised of a floating seal member and seal rings, provides a solution for a drilling rig swivel and/or a top drive that is reliable, operable at a fluid pressure up to 7,500 psi, with an extended working life, easy to install and commission, easy to change and maintain, and reduces the rig downtime.

Although several exemplary embodiments have been shown and described, it would be appreciated by those skilled in the art that various changes or modifications may be made in these embodiments without departing from the principles and spirit of the disclosure, the scope of which is defined in the claims and their equivalents.

What is claimed is:

1. A washpipe assembly, comprising:

a lower union secured to a rotating conduit member;

an upper union secured to a stationary conduit member;

a floating seal assembly secured to said upper union, said floating seal assembly comprising a floating member, a fixed member secured to said upper union and configured to guide said floating member, and a spring member installed between said floating member and said fixed member such that said floating member is movable in an axial direction relative to said fixed member;

a rotating seal ring attached to said floating seal assembly;

a stationary seal ring attached to said lower union; and a washpipe hung up inside said upper union and said floating seal assembly through a waveform snap ring mounted between said upper union and said floating seal assembly.

2. The washpipe assembly according to claim 1, wherein said floating member is composed of a floating tube and a lower flange installed onto said floating tube;

said stationary seal ring is mounted to said floating tube, and a first end of said spring member is supported by said lower flange; and said fixed member comprises a tubular pilot and an upper flange, said tubular pilot is configured to guide a movement of said floating member, and a second end opposite said first end of said spring member is attached to said upper flange.

3. The washpipe assembly according to claim 2, wherein one of said tubular pilot and said floating tube is formed with a piloting groove, and the other one of said tubular pilot and said floating tube is formed with a raised part sliding axially in said piloting groove.

4. The washpipe assembly according to claim 3, wherein said spring member is composed of a spring, and a guide rod installed inside said spring, and wherein a first end of said guide rod is fixed to said upper flange and an end opposite the first end of said guide rod is configured to allow said lower flange to approach to or depart from said upper flange axially.

5. The washpipe assembly according to claim 4, wherein elastomeric seals are disposed between an outer circumference of said washpipe and the inner circumference of said upper union, and between an outer circumference of said washpipe and an inner circumference of said floating tube.

6. The washpipe assembly according to claim 4, wherein said upper flange is formed with a positioning stage on an inner circumference thereof, and wherein a first end of said waveform snap ring is attached to said positioning stage of said upper flange and a second end of said waveform snap ring opposite to the first end is attached to a positioning stage formed in said upper union.

7. The washpipe assembly according to claim 4, wherein a first gap is provided between the top of said raised part and the bottom of said piloting groove, and/or, a second gap is provided between the outer circumference of said floating tube and the inner circumference of said lower flange, and/or, a third gap is provided between said guide rod and said lower flange.

8. The washpipe assembly according to claim 1, wherein each of said stationary seal ring and said rotating seal ring is composed of an inner ceramic ring and an outer metal ring.

9. The washpipe assembly according to claim 8, wherein said metal rings of said stationary seal ring and said rotating ring are non-rotatably installed to said floating assembly and said lower union, respectively.

10. The washpipe assembly according to claim 9, wherein each of the ceramic ring of said stationary seal ring and the ceramic ring of said rotating seal ring is provided with an O-ring chamber on an end opposite a seal end thereof, and wherein an O-ring is installed in the O-ring chamber to provide a sealing effect between said stationary seal ring and said floating tube, and between said rotating seal ring and said lower union.

* * * * *